United States Patent [19]

Spurry

[11] 4,330,241

[45] May 18, 1982

[54] GEAR PUMP WITH PRESSURE LOADED BEARING BLOCKS AND SEPARATE GEAR SEALING PLATES

[75] Inventor: Roderick H. Spurry, Swindon, England

[73] Assignee: Plessey Overseas Limited, Ilford, England

[21] Appl. No.: 75,106

[22] Filed: Sep. 13, 1979

[30] Foreign Application Priority Data

Sep. 15, 1978 [GB] United Kingdom ..... 37071/78

[51] Int. Cl.[3] ..... F04C 2/18; F04C 15/00

[52] U.S. Cl. ..... 418/132; 418/189

[58] Field of Search ..... 418/131, 132, 135, 178, 418/189

[56] References Cited

U.S. PATENT DOCUMENTS

| | | | |
|---|---|---|---|
| 2,527,941 | 10/1950 | Lauck et al. | 418/135 |
| 3,057,302 | 10/1962 | Lockett | 418/132 |
| 3,113,524 | 12/1963 | Fulton | 418/189 |
| 3,131,643 | 5/1964 | Marietta | 418/132 |
| 3,292,551 | 12/1966 | Gordon | 418/132 |
| 4,124,335 | 11/1978 | Jons et al. | 418/132 |

*Primary Examiner*—John J. Vrablik

*Attorney, Agent, or Firm*—Ted E. Killingsworth; James A. Wanner; Harold A. Williamson

[57] ABSTRACT

A gear pump having a pair of intermeshing gears which operate in a housing and which are supported by a pair of bearing blocks which are biased towards the side faces of the gears for effecting a seal. There is interposed, between each bearing block and the adjacent side faces of the gears, a flexible plate which on its outer side is pressure-loaded by pump-delivery pressure admitted to an area of the plate confined by a linear seal element that includes part-circular portions extending around the gear axes at a radial distance appreciably smaller than the radius of the root circle of the gear teeth. The leakage flow from the intermeshing gear teeth to the bearing bores between the adjacent surfaces of the flexible plate and a continuous surface of each gear inside its gear root circle produces, in the area between the root circle and the circular portions of the seal element, a pressure difference which deflects the plate to minimize the width of the gap through which the leakage flow passes, thus preventing the access to that area of any but the smallest contaminating particles.

3 Claims, 3 Drawing Figures

GEAR PUMP WITH PRESSURE LOADED BEARING BLOCKS AND SEPARATE GEAR SEALING PLATES

This invention relates to a gear pump with pressure-loaded bearing blocks, and it has the object of improving the usefulness of such a pump for pumping liquids that contain particulate contamination. In U.S. Pat. No. 4,124,335, there is described a gear pump whose housing contains, at each side of the gears, a split bearing block and, interposed between each bearing block and the side faces of the gears, a separate sealing plate which is pressure-loaded by pump-delivery pressure into engagement with the gear end faces, this plate being of such thickness as to be rigid. It has been found that, when a pump of this or similar construction is used for pumping liquid containing particulate contamination, the life of the pump is very considerably shortened by rapid wear or erosion of the area of the cooperating sealing surfaces inside the root circle of each gear. The present invention has, as a more specific object, the provision of an improved pump construction which greatly reduces the rate of this deterioration.

With this and other objects in view, the invention provides a gear pump having a pair of intermeshing gears which cooperate in a pump housing, and which are supported by a pair of bearing blocks which are biased towards the side faces of the gears, the improvement comprising a flexible plate interposed between each bearing block and the adjacent side faces of the gears and movable in the pump housing towards and away from the gears, the plate covering the entire side face of the intermeshing gears and being pressure-loaded towards the gears by pump delivery pressure acting on a predetermined area of the outer side of the plate to produce a force in excess of the oppositely directed force by the pressure reaching the inner surface of the plate from the tooth gaps approaching the region of intermesh. The predetermined area is confined by a resilient linear seal element so located in a groove in each bearing block as to include part-circular portions in which the resilient seal element faces the flexible plate. A continuous end-face area of each gear is situated radially inwardly of the roots of the teeth of the gear by a sufficient distance to define an appreciable part-annular area facing the flexible plate in which the sliding contact between the continuous end face of the gear and the cooperating surface portion of the flexible plate forms a narrow gap having a resistance to leakage flow from the tooth-gap area towards the journal bearing of each gear, which resistance reduces the mean pressure acting on the inner side of the plate in the gap relative to the pump delivery pressure acting on the corresponding area at the outer side of the flexible plate. The resulting pressure difference tends to minimize the width of the gap.

A considerable reduction in the rate of wear is achieved by the construction according to the present invention, and this is believed to be due to the fact that the above-mentioned pressure difference in pressure-loaded area inside the root circle of each gear, in conjunction with the flexibility of the interposed plate of the invention, results in a considerable reduction in the width of the leakage gap in the area in question. Thus, contamination particles, except those of the smallest particle sizes, are prevented from entering the gap, and are thus prevented from exerting their eroding effect upon the cooperating surface areas in which rapid erosion had hitherto been expected, with resultant shortening of the life of the pump.

Usually, each flexible plate will have the same profile as the profile of the bearing blocks.

Preferably, each flexible plate is a bronze faced plate. However, if desired, it may be made from other materials such for example as Nylon, Tufnol, tungsten carbide, surface treated ferrous materials and chrome steel.

Also preferably, each plate has relief slots for preventing the build up of trapped fluid pressure between the intermeshing gears. Other means may be employed such for example as removing other parts of the plate, for preventing the build up of trapped fluid pressure between the intermeshing gears.

An embodiment of the invention will now be described solely by way of example and with reference to the accompanying drawings in which.

Figure 1:
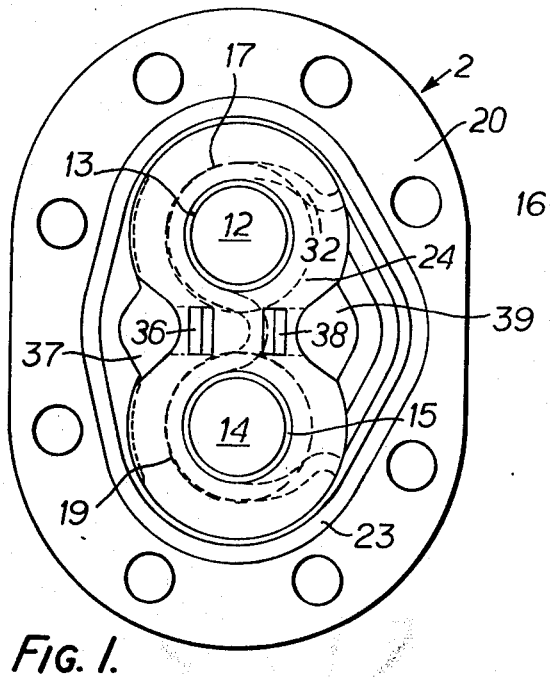
FIG. 1 is a transverse cross section through a gear pump in accordance with the invention.

Referring to the drawings, there is shown a gear pump 2. A pair of intermeshing gears 4, 6 having shafts 8, 10 respectively, which pass through the bores 12, 14 and the bearing bushes 13, 15 provided in each of a pair of bearing blocks 16, 18, and the gears 4, 6 and the bearing blocks 16, 18 are located in a pump housing 20. Various parts of the housing 20 are held together by dowels and bolts not shown, which are inserted in bores 22.

Figure 2:
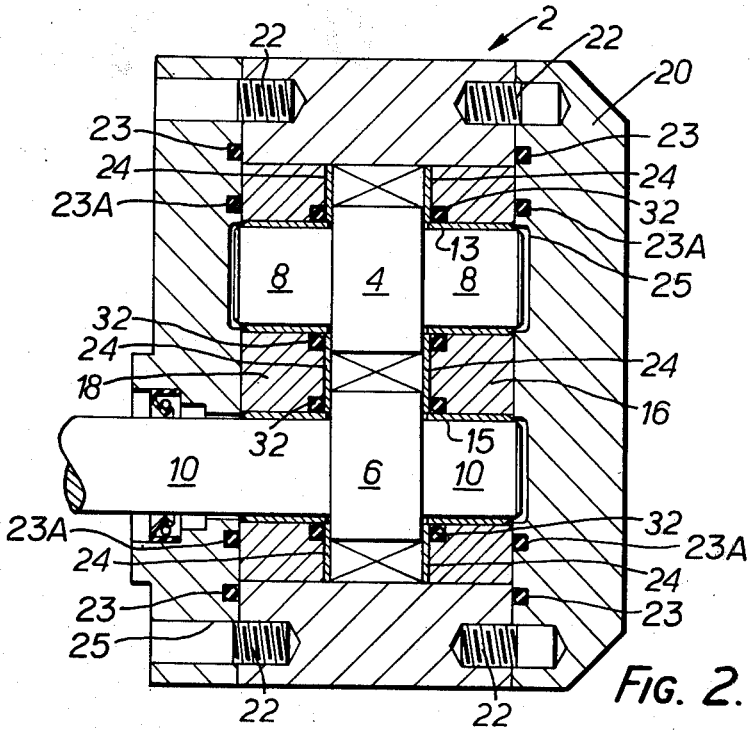
FIG. 2 is an axial cross section through the gear pump illustrated in FIG. 1.

The bearing blocks 16, 18 are biased by fluid pressure in the gear pump towards the side faces of the gears 4, 6 as shown most clearly in FIG. 2. This biasing of the bearing blocks 16, 18 is effected by seals 23 and 23A. The latter separates an area which communicates with the high pressure from the pump-delivery port 37, from an area which communicates with the low pressure of the pump-inlet port 39, and includes the outer ends of the bores 12 and 14 of the bearing block. The seals 23 are forced by hydraulic pressure in a well-known manner into sealing contact with the walls of their grooves 25, and the trapped liquid between the seals acts on the face of the bearing blocks 16, 18 adjacent the housing 20 to force the bearing blocks 16, 18 away from the housing 20 and toward the gears 4, 6. The gear pump 2 has a flexible bronze-faced plate 24 interposed between each bearing block and the adjacent side faces of the gears 4, 6. The plate 24 is of the same profile as the profile of the bearing blocks 16, 18, and is therefore in the shape of the numeral 8. The plate 24 engages the entire side face of its gears 4, 6. Each plate 24 is pressure-loaded by the admission to its outer surface of high pressure from the pump-delivery port 37 into an area confined by a linear seal 32, which is accommodated in a groove 34 in the adjacent surface of the bearing blocks 16, 18, from which the seal member projects to provide, between the bearing block and the plate 24, a gap 29 in which the pump-delivery pressure can act.

Figure 3:
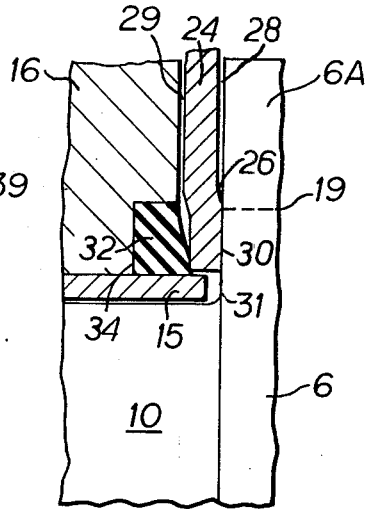
FIG. 3 is an enlarged detail of part of the gear pump shown in FIGS. 1 and 2.

As shown in FIGS. 1 and 3, the seal element 32 includes particular portions which follow, for approximately 180°, the contour of the bushes 13 and 15 for the shafts 8 and 10, respectively, and in which the seal element 32 engages the plate 24 at an appreciable radial distance inside the root circle 17, 19 of each gear. This enables localized sealing to be obtained in the gear under-tooth-root areas, as will be explained below.

Each plate 24 is provided with a pair of slots 36, 38, these slots being release slots for preventing a build-up of trapped fluid pressure between the intermeshing parts of the gears 4, 6. The slot 36 is near the pump outlet port 37 and the slot 38 is near a pump inlet port 39.

When the pump is in operation, a certain amount of liquid under pressure at the approach side of the zone of intermesh of the gears will seep through the zone 30 of sliding contact between the flexible plate 24, pass through the annular space 31 at the end of each bush 13, 15, and flow along the journal portion of the shaft 8 or 10 through the bore 12 or 14 of the bearing bush 13 or 15 to the low-pressure area of the pump. As a result of this, the mean pressure acting on the part-annular zone 30 of the flexible plate 24, which faces the under-root zone of each gear, will be lower than the pump-delivery pressure that acts on the corresponding zone on the opposite side of the flexible plate, which it reaches through the gap 29, and the resulting pressure difference will act to ensure, in conjunction with the flexibility of the plate, maintenance in this zone of a minimum width of gap between the plate 24 and the adjacent end face of the gear. The flexibility of the plate 24 allows the latter to be slightly deformed to narrow the gap in this zone relative to that in the area in which pump-delivery from the tooth gaps substantially balances the pump-delivery pressure from the delivery port 37, which acts on the outer surface of the plate 24. This slight deformation is shown greatly exaggerated in FIG. 3 at the transition from gap 28 to gap 30. The narrowness of the gap 30 will act to prevent any but the smallest particles of contamination from reaching and eroding the under-root zones of the gears and the adjacent portions of the pressure-loaded plate 24. In hitherto known pumps, such erosion led to rapid widening of the gap, and thus, an increase in the leakage flow through the gap between the cooperating sealing surfaces of the plate and gears in the under-root zones thereof, and thence, through the bearing bores to the low-pressure part of the pump. In the pump of the invention, however, the pressure difference acting on these zones of the flexible sealing plate will deflect the portions in question to compensate largely for such erosion as may take place, and to maintain the narrow width of the gap in question for a considerable period, even if the remainder of the sealing faces show little wear.

Release slots 36 and 38 are additionally provided in the illustrated embodiment, which slots 36 and 38 serve in a known manner for the release of liquid which otherwise would be trapped in tooth gaps between two teeth which are simultaneously in sealing contact with each other. They thus counteract any rise in the pressure in the gap between the sealing plate and the under-root area of the gear faces which might result from the high pressure of such trapped liquid.

Such wear as still does occur in these areas, caused by the smaller contaminant particles, is compensated for by further deflection of the pressure plate, maintaining minimum clearance and reducing leakage of high pressure oil to an acceptable level.

It is to be appreciated that the embodiment of the invention described above has been given by way of example only and that modifications may be effected.

I claim:

1. In a gear pump having a pair of intermeshing gears which cooperate in a pump housing and are supported by a pair of bearing blocks which are biased towards the side faces of the gears;

the improvement comprising a flexible plate interposed between each bearing block and the adjacent side faces of the gears and movable in the pump housing toward and away from the gears, the plate covering the entire side face of the intermeshing gears and being pressure-loaded toward the gears by pump-delivery pressure acting on a predetermined area of the outer side of the plate to produce a force in excess of the oppositely directed force by the pressure reaching the inner surface of the plate from the tooth gaps approaching the region of intermesh, said predetermined area being confined by a resilient linear seal element so located in a groove in each bearing block as to include part-circular portions in which the resilient seal element faces the flexible plate, a continuous end-face area of each gear situated radially inwardly of the roots of the teeth of the gear by a sufficient distance to define an appreciable part-annular area facing the flexible plate in which sliding contact between the continuous end face of the gear and the cooperating surface portion of the flexible plate forms a narrow gap having a resistance to leakage flow from the tooth-gap area towards the journal bearing of each gear, which resistance reduces mean pressure acting on the inner side of the plate in the said gap relative to the pump delivery pressure acting on the corresponding area at the outer side of the flexible plate, whereby the resulting pressure difference tends to minimize the width of said gap.

2. A gear pump according to claim 1, wherein each plate has the same profile as the profile of the bearing block.

3. A gear pump according to claim 1, wherein each plate has release slots for preventing the build-up of trapped fluid pressure between the intermeshing gears.

* * * * *